US008308906B2

(12) United States Patent
Page et al.

(10) Patent No.: US 8,308,906 B2
(45) Date of Patent: Nov. 13, 2012

(54) UNIDIRECTIONAL DISCHARGE GRATE ASSEMBLY

(75) Inventors: David J. Page, Elora (CA); Pramod Kumar, Waterloo (CA); Robert Mepham, Fergus (CA)

(73) Assignee: Polycorp Ltd., Elora, ON (CA)

( * ) Notice: Subject to any disclaimer, the term of this patent is extended or adjusted under 35 U.S.C. 154(b) by 0 days.

(21) Appl. No.: 13/056,684

(22) PCT Filed: Jul. 30, 2009

(86) PCT No.: PCT/CA2009/001085
§ 371 (c)(1),
(2), (4) Date: Mar. 1, 2011

(87) PCT Pub. No.: WO2010/012105
PCT Pub. Date: Feb. 4, 2010

(65) Prior Publication Data

US 2011/0146933 A1 Jun. 23, 2011

Related U.S. Application Data

(60) Provisional application No. 61/085,600, filed on Aug. 1, 2008.

(51) Int. Cl.
*D21F 1/00* (2006.01)

(52) U.S. Cl. ..... 162/232; 241/70

(58) Field of Classification Search ..... 162/232; 241/70, 24, 30, 183
See application file for complete search history.

(56) References Cited

U.S. PATENT DOCUMENTS

| | | | |
|---|---|---|---|
| 3,231,203 | A | 1/1966 | Russel et al. |
| 3,739,993 | A | 6/1973 | Nelson et al. |
| 3,785,577 | A | 1/1974 | Carlsmith et al. |
| 3,806,045 | A | 4/1974 | Jenness |
| 3,987,970 | A | 10/1976 | Burkett |
| 4,049,206 | A | 9/1977 | Konig et al. |
| 4,312,749 | A | 1/1982 | Bingham |
| 4,365,763 | A | 12/1982 | Guerguerian |
| 4,441,659 | A | 4/1984 | Marklund |
| 4,533,054 | A | 8/1985 | Sommer, Jr. et al. |
| 4,542,856 | A | 9/1985 | Adolph |
| 4,646,980 | A | 3/1987 | Player et al. |
| 4,836,457 | A | 6/1989 | Greiner |
| 4,982,904 | A | 1/1991 | Greiner |
| 5,361,997 | A | 11/1994 | Burkes |
| 5,381,971 | A | 1/1995 | Rehmer |
| 5,598,981 | A | 2/1997 | Hellmich |
| 5,722,607 | A | 3/1998 | Hellmich |
| 6,663,030 | B2 | 12/2003 | Washburn et al. |
| 7,204,636 | B2 | 4/2007 | Didion |
| 2005/0152217 | A1 | 7/2005 | O'Hara |
| 2006/0283993 | A1 | 12/2006 | Latchireddi |

FOREIGN PATENT DOCUMENTS

| | | |
|---|---|---|
| WO | WO9801226 | 1/1998 |
| WO | PCT/CA2009/001085 | 7/2009 |

*Primary Examiner* — Mark Halpern

(57) ABSTRACT

A discharge grate assembly for at least partially guiding slurry from a mill shell chamber in a rotating mill shell to a discharge trunnion thereof via a pulp lifter chamber. The discharge grate assembly includes a body having a number of apertures for permitting the slurry to flow from the mill shell chamber into the pulp lifter chamber. The discharge grate assembly also includes a number of louvers movable between a closed position, in which the apertures in the body are at least partially covered by the louvers, and an open position, in which the apertures are at least partially unobstructed by the louvers.

22 Claims, 10 Drawing Sheets

UNIDIRECTIONAL DISCHARGE GRATE ASSEMBLY

This application is a 371 of PCT/CA2009/001085 filed 30 Jul. 2009

FIELD OF THE INVENTION

This invention is related to a discharge grate assembly for guiding slurry from a mill shell chamber in a rotating mill shell to a discharge trunnion thereof via a pulp lifter chamber.

BACKGROUND OF THE INVENTION

In a grinding mill, slurry flows from a mill shell chamber into pulp lifter chambers due to charge pressure and gravity as the mill shell rotates. Slurry is directed out of the mill (typically, via a central opening to a discharge trunnion) by pulp lifters or similar elements which define the pulp lifter chambers therebetween. As is well known in the art, each pulp lifter chamber is also partially defined by a mill grate, or discharge grate.

The pulp lifters typically are mounted on a discharge end wall (or mill head) of the mill. Often, the end wall is positioned at an angle (e.g., 75°) relative to a center line of the central opening in the end wall, i.e., the end wall forms a truncated cone. However, substantially vertical end walls are also common. As is known, a charge typically is positioned in a lower part of the mill shell chamber, filling the mill shell chamber to a limited extent.

As is known, the slurry flows into the pulp lifter chamber via apertures in the mill grate as the mill shell rotates. (For the purposes of discussion herein, rotation is assumed to be counter-clockwise, i.e., the discharge end, as viewed from inside the mill shell chamber, is assumed to rotate counter-clockwise. However, as is known, rotation may be clockwise or counter-clockwise.) In practice, slurry flows into a particular pulp lifter chamber under the influence of charge pressure and gravity when that chamber is between about the 8 o'clock and the 4 o'clock positions. As the mill shell rotates in a counter-clockwise direction, the particular chamber is raised from the 4 o'clock position upwardly to the 12 o'clock position, after which the chamber moves downwardly. As the chamber is so raised, and also as the chamber is lowered (i.e., after it has passed the 12 o'clock position), slurry flows from the chamber to the discharge trunnion.

Typically, the mill is rotated at a relatively high speed, to achieve optimal throughput. For example, a typical mill with an internal diameter of about 32 feet (approximately 9.8 meters) may rotate at about 10 revolutions per minute. Any decrease in rotation speed is understood to be counterproductive, as any such decrease would also decrease throughput, as is well known in the art.

In the prior art, attempts to increase production (i.e., mill throughput) have focused on increasing the sizes and/or the numbers of the apertures in the mill grates (or discharge grates). The idea is that a grate having larger apertures, and/or more apertures, should result in a larger volume of slurry flowing through the grate, and therefore into the pulp lifter chamber from the mill shell chamber, in a certain time period.

However, this assumes—incorrectly—that all the slurry in the pulp lifter chamber is moved out of the mill via the discharge trunnion. As is known, in practice, a portion of the slurry typically flows back into the mill shell chamber via the apertures in the mill grate as the mill shell rotates. Depending on the circumstances, the "back flow" may be relatively large. Typically, back flow of the slurry from a particular pulp lifter chamber occurs when that chamber is between about the 3 o'clock position and about the 9 o'clock position. Back flow generally is a more significant problem in mills with inclined discharge end walls.

It is clear that back flow has a negative impact on mill productivity, and it is also clear that back flow may have a very significant negative impact (especially where the end wall is inclined), depending on its volume. In any event, back flow clearly undermines attempts to increase mill productivity which are sought to be achieved solely by increasing the sizes and/or the numbers of the apertures in mill grates.

SUMMARY OF THE INVENTION

For the foregoing reasons, there is a need for an improved discharge grate assembly.

In its broad aspect, the invention provides a discharge grate assembly for at least partially guiding slurry from a mill shell chamber in a rotating mill shell to a discharge trunnion thereof via a pulp lifter chamber. The discharge grate assembly includes a body having a number of apertures for permitting the slurry to flow from the mill shell chamber into the pulp lifter chamber. Also, the discharge grate assembly includes a number of louvers movable between a closed position, in which the apertures in the body are at least partially covered by the louvers, and an open position, in which the apertures are at least partially unobstructed by the louvers.

In another aspect, each louver is integrally formed with the body and is movable relative to each aperture respectively between the closed and open positions.

In another of its aspects, the discharge grate assembly includes a frame on which the louvers are mounted.

In yet another of its aspects, the discharge grate assembly includes a frame, in which each louver is integrally formed with the frame and is movable relative to each aperture respectively between the closed and open positions.

In another aspect, the invention provides a grinding mill with a shell rotatable in a predetermined direction about a central axis thereof to produce a slurry including liquid and particles from a charge in the shell. The grinding mill includes a discharge end wall attached to the shell, the discharge end wall extending between an outer edge thereof connected to the shell and an inner edge at least partially defining a central opening in the discharge end wall, and a number of pulp lifter elements mounted on the discharge end wall, adjacent ones of the pulp lifter elements at least partially defining pulp lifter chambers therebetween respectively. The grinding mill also includes one or more discharge grate assemblies positioned on the pulp lifter elements. Each discharge grate assembly includes a body with a number of apertures therein. Each pulp lifter chamber is rotatable in the predetermined direction between a submerged condition, in which each body is at least partially submerged in the charge, and a raised condition, in which at least a portion of the slurry in each pulp lifter chamber is drainable into the central opening. Each discharge grate assembly is adapted to screen the slurry through the apertures thereof as the slurry flows into each pulp lifter chamber, while each pulp lifter chamber is in the submerged condition. Each discharge grate assembly additionally includes a number of louvers movable between an open position, in which the apertures are at least partially unobstructed by the louvers to permit the slurry to flow into the pulp lifter chamber when the pulp lifter chamber is in the submerged condition, and a closed position, in which the apertures are at least partially obstructed by the louvers to direct at least the portion of the slurry in each said pulp lifter chamber to the central opening when the pulp lifter chamber is in the raised position.

In another aspect, each louver is integrally formed with the body and is movable relative to the body between the closed and open positions.

In another of its aspects, each discharge grate assembly includes a frame on which the louvers are mounted.

Also, in another aspect, each louver is integrally formed with the frame and is movable relative to each aperture respectively between the closed and open positions.

In another of its aspects, the invention provides a discharge grate assembly for screening slurry flowing from a mill shell chamber in a rotating mill shell into a pulp lifter chamber. The grate assembly includes a body having a number of apertures sized for permitting the slurry with predetermined particle size characteristics to flow from the mill shell chamber to the pulp lifter chamber, and a number of louvers positioned for at least partially covering one or more of the apertures. Each louver is movable between a closed position, in which the louver at least partially covers the aperture(s), and an open position, in which the louver permits the slurry to flow through the aperture(s) into the pulp lifter chamber.

In another of its aspects, the invention provides a grinding mill which includes one or more discharge grate assemblies positioned on the pulp lifter elements. Each discharge grate assembly has a body with a plurality of apertures thereon. In addition, each discharge grate assembly is adapted to screen the slurry through the apertures thereof as the slurry flows into each pulp lifter chamber respectively while each pulp lifter chamber is in the submerged condition. Also, each discharge grate assembly includes a number of louvers. Each louver is disposed in a predetermined position relative to each aperture respectively to permit the slurry to flow into each pulp lifter chamber when the pulp lifter chamber is in the submerged condition respectively, and to direct at least the portion of the slurry in each pulp lifter chamber respectively to the central opening when the pulp lifter chamber is in the raised position.

In yet another aspect, the invention provides a discharge grate assembly in which a number of louvers are fixed in position relative to the apertures in the body. Each aperture is disposed relative to each aperture respectively to permit the slurry to flow into each pulp lifter chamber when the pulp lifter chamber is in the submerged condition respectively, and to direct at least a portion of the slurry in each pulp lifter chamber respectively to the central opening when the pulp lifter chamber is in the raised position.

BRIEF DESCRIPTION OF THE DRAWINGS

The invention will be better understood with reference to the attached drawings, in which.

DETAILED DESCRIPTION

Figure 1:
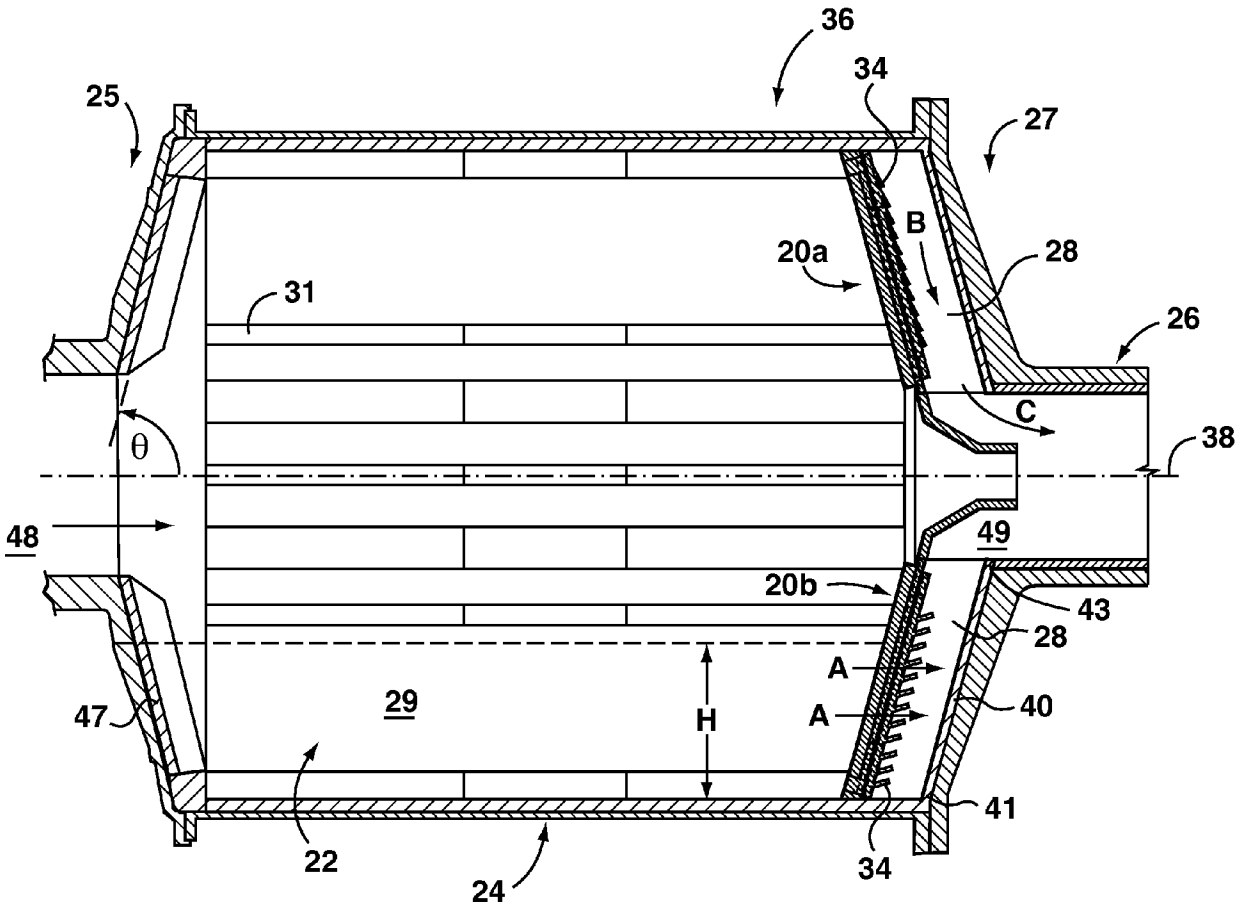
FIG. 1 is a cross-section of an embodiment of a grinding mill of the invention.

Reference is first made to FIGS. 1-4A and 5 to describe an embodiment of a discharge grate assembly in accordance with the invention indicated generally by the numeral 20. The discharge grate assembly 20 is for at least partially guiding slurry from a mill shell chamber 22 in a rotating mill shell 24 to a discharge trunnion 26 via a pulp lifter chamber 28 (FIG. 1). Preferably, the discharge grate assembly 20 includes a body 30 having a number of apertures 32 (FIG. 3) for permitting the slurry to flow from the mill shell chamber 22 to the pulp lifter chamber 28. The grate assembly 20 preferably also includes a number of louvers 34 movable between a closed position, in which the apertures 32 in the body are at least partially covered by the louvers 34, and an open position, in which the apertures 32 are at least partially unobstructed by the louvers 34.

Preferably, and as will be described, in one embodiment, each louver 34 is movable between the closed and open positions at least partially due to gravity as the mill shell 24 rotates.

An embodiment of a grinding mill 36 of the invention which includes a number of discharge grate assemblies 20 is shown in FIG. 1. The mill shell 24 is rotatable about a central axis 38 thereof. As can be seen in FIG. 1, the pulp lifter chambers 28 are at least partially defined by a discharge end wall 40 which is attached to the mill shell 24. The pulp lifter chambers 28 are also at least partially defined by pulp lifter elements 42 (FIG. 5), to which the discharge grate assemblies 20 are also attached. Accordingly, it can be seen that rotation of the mill shell 24 about its central axis 38 also results in rotation of the discharge end wall 40, the pulp lifter elements 42, and the discharge grate assemblies 20 about the central axis 38. For clarity, in the following description, it is assumed that rotation of the mill shell is counter-clockwise, i.e., the discharge end wall 40 rotates in a counter-clockwise direction, as viewed from inside the mill shell chamber. As will be described, each pulp lifter chamber 28 is rotated between a submerged condition, in which the body 30 is at least partially submerged in the charge, and a raised position, in which at least a portion of the slurry in the pulp lifter chamber is drainable therefrom.

The mill shell 24 extends between an intake end 25 and a discharge end 27 (FIG. 1). Preferably, the grinding mill 36 includes an intake end wall 47 at the intake end 25, with a central opening 48 therein through which ore and water are introduced into the mill shell chamber 22 (FIG. 1). As can be seen in FIG. 1, the charge 29 (i.e., the ore and water in the mill shell chamber 22) typically occupies no more than about the lower one-third of the mill shell chamber 22. As an example, the charge 29 has a depth "H" in the mill shell chamber 22 in FIG. 1. As is well known in the art, as the mill shell 24 rotates, the charge 29 is raised by lifter bars 31 therein and allowed to fall on itself, so that the rocks of ore are reduced in size by comminution, resulting in the slurry, i.e., a mixture of the water and the particles or pieces of rock created by the comminution. Also, due to the intake end 25 being slightly higher than the discharge end 27, the charge 29 gradually moves toward the discharge end 27 as the mill shell 24 rotates.

Figure 2:
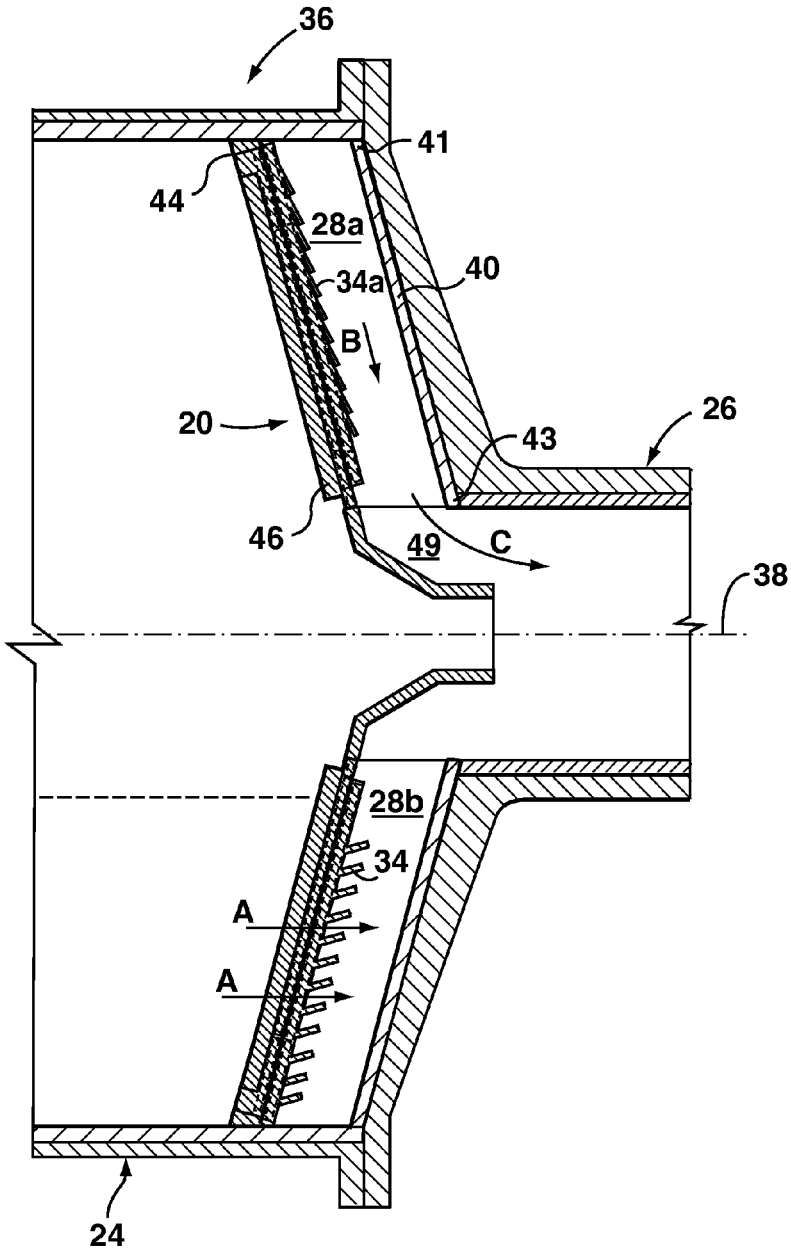
FIG. 2 is a cross-section of a portion of the grinding mill of FIG. 1 including an embodiment of a discharge grate assembly of the invention, drawn at a larger scale.

As is known, the apertures 32 are sized to screen the slurry so that particles at a maximum predetermined size (i.e., the aperture size) or smaller are permitted therethrough. The slurry is allowed to flow into the pulp lifter chamber 28 when the chamber is in the submerged condition and, when the pulp lifter chamber is in the raised position, exiting the pulp lifter chamber 28. As can be seen in FIG. 1, after exiting the pulp lifter chamber, the slurry flows through a central opening 49 in the discharge end wall 40 to exit the grinding mill via the discharge trunnion 26 (FIG. 2). As can be seen in FIGS. 1 and 2, the central opening 49 preferably is positioned at least partially inside the discharge trunnion 26, which partially supports the shell 24. Because the manner in which the mill shell 24 is supported by trunnions is well known in the art, it is not necessary to provide further description of the trunnions.

In one embodiment, the discharge grate assembly 20 is for screening slurry flowing from the mill shell chamber 22 in the rotating mill shell 24 into a pulp lifter chamber 28. The discharge grate assembly 20 preferably includes the body 30 with a number of apertures 32 sized for permitting the slurry with predetermined particle size characteristics to flow from the mill shell chamber 22 to the pulp lifter chamber 28. The assembly 20 preferably also includes a number of louvers 34 positionable for at least covering the apertures. The louvers 34 are movable between a closed position, in which the louvers at least partially cover the apertures, and an open position, in which slurry is permitted to flow through the apertures into the pulp lifter chamber.

Figure 5:
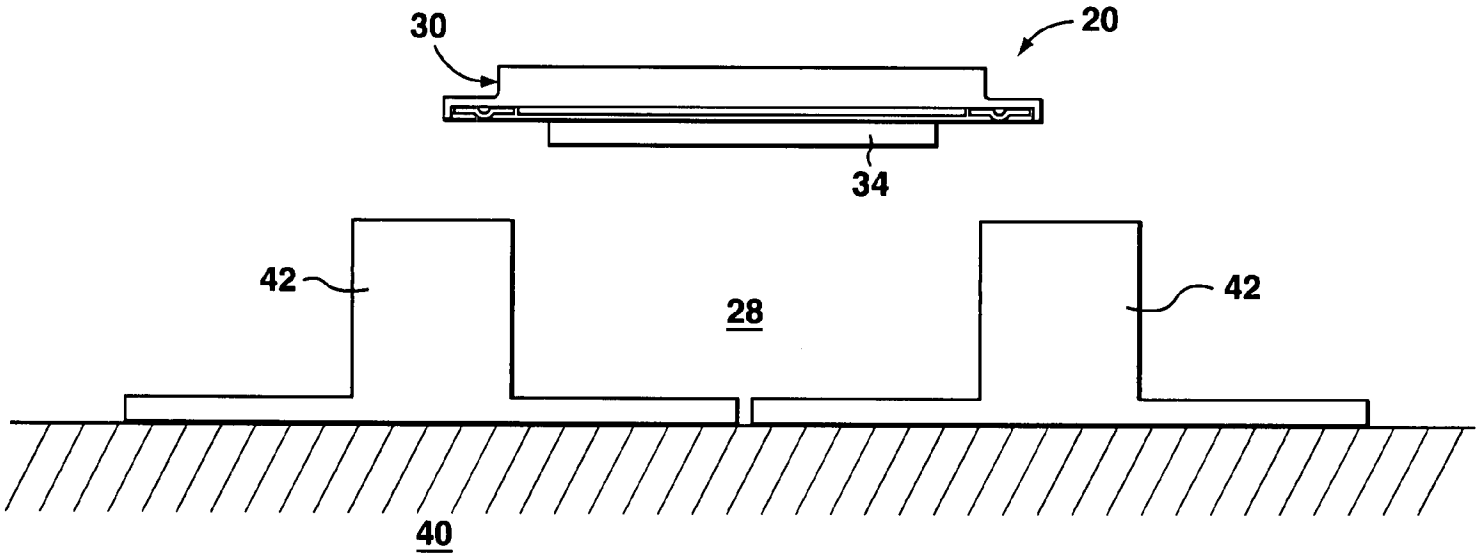
FIG. 5 is another side view of the discharge grate assembly of FIG. 3, drawn at a smaller scale.

For the purposes of illustration, only two pulp lifter chambers (designated 28*a* and 28*b* in FIG. 2 for convenience) are shown in FIG. 2. It will be understood that a number of other pulp lifter chambers which are positioned radially between the pulp lifter chambers 28*a*, 28*b* are not shown in FIGS. 1 and 2, for clarity of illustration. It will also be understood that the pulp lifter elements 42 positioned at the sides of the pulp lifter chambers 28*a*, 28*b* (and partially defining the pulp lifter chambers 28*a*, 28*b*) are not shown in FIGS. 1 and 2, also for clarity of illustration. The pulp lifter elements 42 preferably are mounted on the discharge end wall 40 (FIGS. 1, 2, 5). In addition, those skilled in the art would be aware that elements other than pulp lifter elements may be used to define sides of the pulp lifter chamber. For the purposes hereof, such other elements are considered to be within the term "pulp lifter elements".

In the grinding mill shown in FIGS. 1 and 2, the discharge end wall 40 and the intake end wall 47 are positioned to define an acute angle θ between the discharge end wall 40 and the central axis 38 and also between the intake end wall 47 and the central axis 38 (FIG. 1). For example, in the grinding mill 36 shown in FIG. 1, θ is approximately 75°.

In one embodiment, the discharge grate assembly 20 is positioned substantially parallel to the discharge end wall 40 (FIGS. 1, 2). As noted above, the louvers 34 preferably are, at least in part, moved by gravity between the open and closed positions as the mill shell 24 rotates. Such positioning of the discharge grate assembly 20 relative to the central axis 38 assists in the movement of the louvers 34 between the closed and open positions.

Figure 4B:
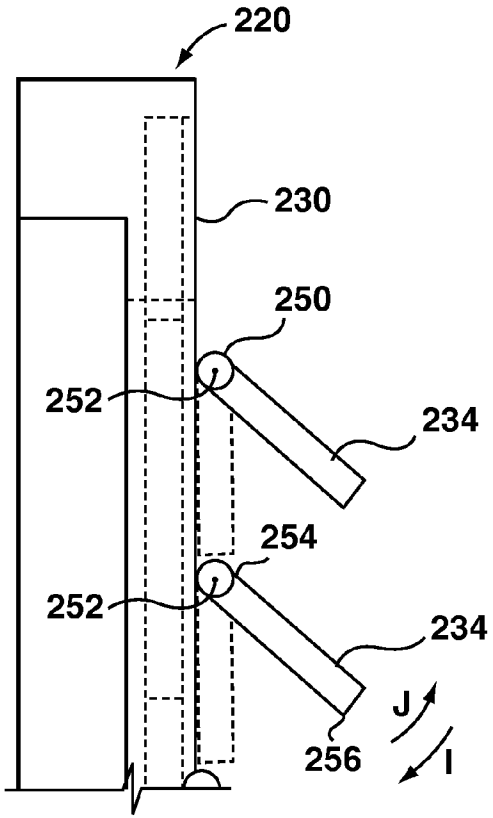
FIG. 4B is a side view of a portion of an alternative embodiment of the discharge grate assembly of the invention, drawn at a larger scale.
Figure 4A:
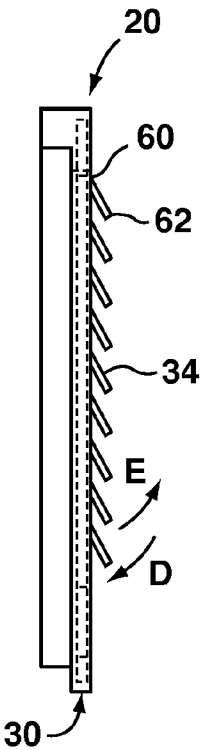
FIG. 4A is a side view of the discharge grate assembly of FIG. 3.
Figure 3:
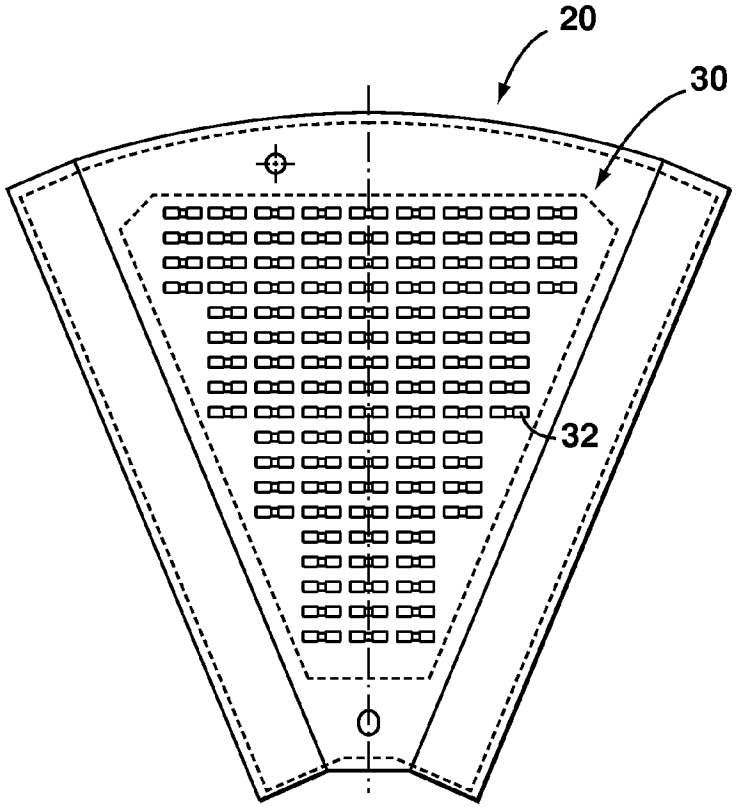
FIG. 3 is a top view of an embodiment of a discharge grate assembly of the invention, drawn at a larger scale.

For example, when the pulp lifter chamber 28*a* is in the 12 o'clock position (as shown in FIG. 2), an outer end 44 of the discharge grate assembly 20 is positioned closer to the intake end wall 47 than an inner end 46 of the assembly 20. Each louver 34 has an inner end 60 which is proximal to or connected to the body (FIG. 4A), and an outer end 62 distal to the inner end 60. As can be seen in FIGS. 1, 2, and 4A, the inner end 60 of each louver 34 is positioned closer to the central axis 38 than the outer end 62 thereof when the discharge grate assembly 20 is mounted on the pulp lifter elements in the grinding mill.

Also, the pulp lifter chamber 28*b* is shown in FIG. 2 in the 6 o'clock position, and the body 30 is positioned non-orthogonally relative to the central axis 38. As will be described, the louvers 34 preferably are positioned to take advantage of the non-orthogonal positioning of the body 30, and the effect of the non-orthogonal positioning is most clearly shown when the pulp lifters are in the 12 o'clock and 6 o'clock positions (FIG. 2).

As noted above, for illustrative purposes, the pulp lifter chambers 28*a*, 28*b* (and the discharge grate assemblies (or mill grate assemblies) 20*a*, 20*b* positioned adjacent thereto respectively) are shown in FIG. 2 positioned respectively at approximately the 12 o'clock position and at approximately the 6 o'clock position. As can be seen in FIG. 2 (and as described above), when the pulp lifter chamber 28*a* is at the 12 o'clock position, because the louvers are not vertical, and also because the louvers' outer ends 62 are positioned higher than the inner ends 60 thereof, the louvers 34*a* have a tendency to be in the closed position. As will be described, the flow of slurry over the louvers 34 when the pulp lifter chamber 28 is in the raised condition also tends to push down and to maintain the louvers 34 in the closed position.

It will be appreciated that the louvers 34 generally tend to move from the open position to the closed position as the louvers 34 are moved from about the 3 o'clock position to about the 12 o'clock position. As noted above, this movement from the open position to the closed position is partly due to the influence of gravity, but it also is partly due to the flow of slurry in the pulp lifter chamber toward the discharge trunnion as the pulp lifter chamber 28 is raised. The slurry flows generally inwardly (i.e., generally toward the central axis) in the pulp lifter chamber 28 as the pulp lifter chamber 28 is raised, and the weight of the slurry on the louvers, as the slurry rushes over the louvers, pushes the louvers down, i.e., toward the closed position. When the louvers are between about the 3 o'clock and the 9 o'clock positions, once the louvers are closed, they tend to remain closed due to gravity and the weight of slurry in the pulp lifter chamber as the slurry exits therefrom. Accordingly, when the pulp lifter chamber 28 is in a position between approximately 3 o'clock and approximately 9 o'clock, the louvers 34 generally are closed.

Also, the louvers 34 tend to move from the closed position to the open position as the louvers 34 are moved from about the 9 o'clock position to the 6 o'clock position while the mill shell 24 rotates.

While the pulp lifter chamber 28 is moving between approximately 9 o'clock and approximately 3 o'clock, the louvers 34 are moved to the open position. The movement of the louvers from the closed position to the open position, while the louvers are between approximately 9 o'clock and approximately 3 o'clock, is partly due to gravity, and partly due to charge pressure. "Charge pressure" refers to pressure exerted by the charge (i.e., the mixture of substantially large ore particles and water in the mill shell chamber) on the components defining the mill shell chamber and also internally inside the charge. In connection with the discharge and grate assembly, charge pressure in particular refers to pressure exerted by the charge on the slurry adjacent to the discharge grate assembly, providing an impetus to the slurry.

As can be seen in FIG. 2, in the discharge grate assembly partially defining chamber 28*b*, which is in the 6 o'clock position, the louvers 34 are all in the open position. Between about the 9 o'clock and about the 3 o'clock positions, once opened, the louvers tend to remain open due to both gravity and charge pressure.

Accordingly, and as can be seen in FIG. 2, slurry flows into the pulp lifter chamber 28*b* due to the position of the chamber 28*b* relative to the slurry and the charge in the mill shell chamber 22, and also due to the louvers 34 being in the open position. Flow of the slurry into the pulp lifter chamber 28*b* is schematically indicated by arrows "A" in FIG. 2.

The slurry flows from the pulp lifter chamber 28*a* (shown at approximately 12 o'clock in FIG. 2) into the discharge trunnion 26, to exit the grinding mill 36. The flow of slurry from chamber 28*a* is as indicated by arrow "B" in FIG. 2, and the flow of slurry into the discharge trunnion 26 is indicated by arrow "C". As described above, the louvers 34*a* are shown in the closed position in FIG. 2. It will be appreciated that, but for the louvers 34*a* being in the closed position, a significant portion of the slurry in the pulp lifter chamber 28*a* would flow back into the mill shell chamber 22 while the pulp lifter chamber 28*a* is in the raised position.

It will be understood that in most cases, slurry initially moves from the pulp lifter chamber to the discharge trunnion while the pulp lifter chamber is between about 3 o'clock and about 12 o'clock. However, in general, when the pulp lifter chamber is approximately at 12 o'clock, it still contains a significant amount of slurry, due to the speed at which the mill shell 24 is rotated.

It will be appreciated by those skilled in the art that the louvers 34 may be positioned relative to the apertures 32 in various ways. In one embodiment, each louver 34 is integrally formed with the body 30 and is movable relative to each of the apertures respectively between the closed and open positions (FIG. 4A). In FIG. 4A, the direction of movement of the louvers from the open position to the closed position is schematically illustrated by arrow "D", and the direction of movement from the closed position to the open position is schematically illustrated by arrow "E".

Preferably, the louvers are made of any suitable material. In one embodiment, it is preferred that each louver 34 is a flap of resilient material (e.g., a suitable rubber) cut out of a larger piece of such material, e.g., a part of a sheet of rubber. For example, if the aperture has a generally square or rectangular shape, then the louver may be formed by cutting into the rubber to define three sides corresponding to three sides of the aperture (i.e., excluding an outer side of the aperture), with the louver not being cut at its outer side, or end. Instead, at its outer end, the louver preferably remains integrally joined to the rubber sheet. In this way, a "living hinge" may be formed at the outer end of the louver. Other suitable arrangements will occur to those skilled in the art. Preferably, each louver is biased to the closed position. It will be appreciated by those skilled in the art that a hinge mechanism (other than a "living hinge") may become clogged with fines.

It will be appreciated by those skilled in the art that many alternative arrangements are possible. For instance, one louver may advantageously be sized and positioned to cover more than one aperture. Also, other ways of moving the louvers between open and closed positions will occur to those skilled in the art.

As can be seen in FIGS. 1-4A and 5, an embodiment of the grinding mill 36 of the invention includes the discharge end wall 40 attached to the shell 24. The mill shell 24 is rotatable in a predetermined direction about the central axis thereof to produce the slurry including liquid and particles from the charge in the shell. The discharge end wall 40 extends between an outer edge 41 thereof connected to the shell 24 and an inner edge 43 at least partially defining the central opening 49 in the discharge end wall 40 (FIG. 2). In one embodiment, the grinding mill 36 also includes a number of pulp lifter elements 42 mounted on the discharge end wall 40 (FIG. 5). As can be seen in FIG. 5, adjacent ones of the pulp lifter elements 42 at least partially define the pulp lifter chamber 28 therebetween. Preferably, the grinding mill 36 also includes one or more discharge grate assemblies 20 positioned on the pulp lifter elements 42. As described above, each discharge grate assembly 20 preferably includes the body (or discharge grate) 30 thereof, with the apertures 32 therein. Each pulp lifter chamber 28 is rotatable in the predetermined direction between the submerged condition and the raised condition. Preferably, each discharge grate assembly 20 is adapted to screen the slurry through the apertures 32 thereof as the slurry flows into the pulp lifter chamber adjacent thereto, while the pulp lifter chamber is in the submerged condition. Preferably, the discharge grate assembly 20 also includes a number of louvers 34, each movable between the open position, in which the apertures 32 are at least partially unobstructed by the louvers 34, and a closed position, in which the apertures 32 are at least partially obstructed by the louvers 34. When the louvers 34 are in the open position, the slurry is permitted to flow into the pulp lifter chamber adjacent thereto, when the pulp lifter chamber is in the submerged condition. When the louvers are in the closed position, the louvers direct at least the portion of the slurry in the pulp lifter chamber 28 to the central opening 49 when the pulp lifter chamber 28 is in the raised position.

INDUSTRIAL APPLICABILITY

In use, each discharge grate assembly 20 preferably is sized and configured to cover a selected pulp lifter chamber 28. The discharge grate assembly preferably is mounted on the pulp lifter elements at least partially defining the pulp lifter chamber. Once the discharge grate assembly 20 is installed, the louvers 34 open and shut as the mill shell rotates, as described above, to allow slurry to flow through the apertures 32 and to obstruct the apertures 32 respectively.

From the foregoing, it can be seen that the discharge grate assembly of the invention minimizes back-flow of slurry. The louvers are adapted to open when the pulp lifter chamber adjacent thereto is moved to the submerged condition, and the louvers are also adapted to close when the adjacent pulp lifter chamber is moved to the raised condition. In addition, once the louvers are moved to the open position, the louvers tend to remain in the open position while the pulp lifter chamber adjacent thereto is in the submerged condition. Also, once the louvers are in the closed position, the louvers tend to remain in the closed position while the pulp lifter chamber adjacent thereto is in the raised condition.

As noted above, in one embodiment, the louvers 34 are at least partially movable under the influence of gravity between the closed and open positions. In addition, movement of the louvers may be partially due to charge pressure (i.e., when the pulp lifter chamber adjacent to the discharge grate assembly is in the submerged condition) or due to the pressure of slurry in the pulp lifter chamber (i.e., when the pulp lifter chamber is in the raised condition). However, those skilled in the art will appreciate that the louvers may be otherwise movable.

Additional embodiments of the invention are shown in FIGS. 4B and 6-15. In FIGS. 4B and 6-15, elements are numbered so as to correspond to like elements in FIGS. 1-4A and 5.

Figure 10:
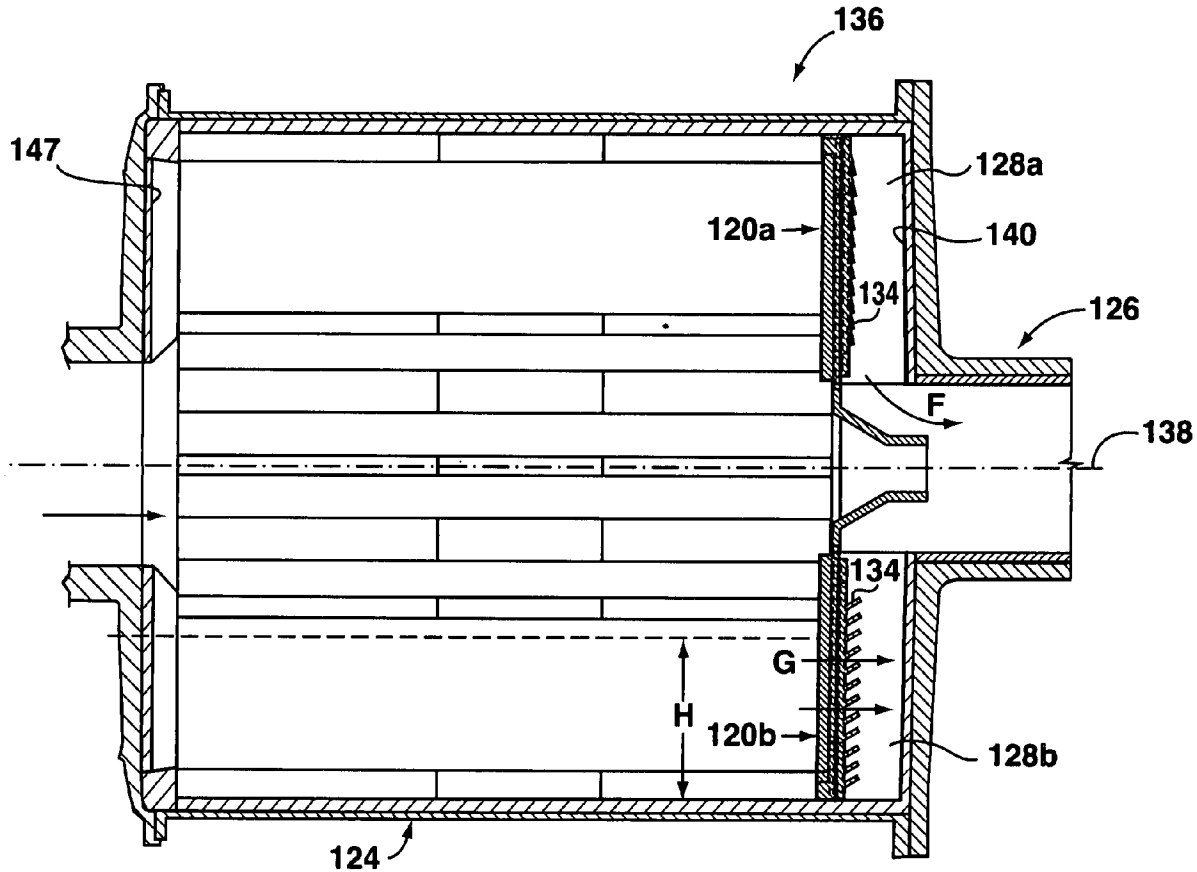
FIG. 10 is a cross-section of another alternative embodiment of the grinding mill of the invention, drawn at a smaller scale.

An alternative embodiment of a grinding mill 136 of the invention is shown in FIG. 10. As can be seen in FIG. 10, the grinding mill 136 includes a mill shell 124 and intake and discharge end walls 147, 140 attached thereto. The intake and discharge end walls 147, 140 are positioned substantially orthogonal to the central axis 138 of the mill shell 124.

Only two of the pulp lifter chambers, identified by reference numerals 128*a*, 128*b*, are shown in FIG. 10, to simply the illustration. When the pulp lifter chamber 128*a* is in the 12 o'clock position (as shown in FIG. 10), slurry exiting therefrom falls substantially downwardly. In FIG. 10, it can be seen that the louvers 134 in the discharge grate assembly 120*a* adjacent to the pulp lifter chamber 128*a* are held in the closed position primarily due to the influence of gravity. To the extent that any such slurry engages the louvers 134 included in the discharge grate assembly 120*a* which at least partially defines the pulp lifter chamber 128*a*, such engagement also serves to maintain the louvers 134 closed, or at least substantially closed. Movement of slurry from the pulp lifter chamber 128*a* into the discharge trunnion 126 is schematically indicated generally by arrow "F" in FIG. 10. In general, as the pulp lifter chamber 128*a* moves from approximately the 3 o'clock position to approximately the 9 o'clock position, the louvers 134 tend to remain in the closed position due to pressure from the slurry in the pulp lifter chamber 128*a* and exiting therefrom.

Pulp lifter chamber 128*b* is at least partially defined by a discharge grate assembly 120*b*. The louvers 134 in the discharge grate assembly 120*b* tend to move to the open position due to charge pressure and gravity as the pulp lifter chamber moves from approximately the 9 o'clock position to approximately the 3 o'clock position, permitting slurry to enter the pulp lifter chamber 128*b* via the apertures 132 while the pulp lifter chamber is in the submerged condition. Movement of the slurry into the pulp lifter chamber 128*b* is schematically indicated by arrows "G" in FIG. 10.

From the foregoing, it can be seen that the discharge grate assembly 120 substantially prevents back-flow of the slurry. Accordingly, the discharge grate assembly of the invention is advantageous regardless of the positioning of the discharge end wall relative to the central axis.

It will be appreciated by those skilled in the art that various means for pivotably connecting the louver to the body may be suitable. In another embodiment, a discharge grate assembly 220 of the invention includes one or more hinges 250 connecting the louvers 234 to the body 230 (FIG. 4B). Each hinge 250 defines a hinge axis 252 thereof about which the louvers 134 are respectively pivotable.

Preferably, each louver 234 includes an outer end 254 positioned distal from the central axis of the mill shell (not shown in FIG. 4B), the hinge axis 252 being positioned proximal to the outer end 254. Each louver 234 extends between the outer end 254 and an inner end 256 thereof, the inner end 256 being positioned closer to the central axis than the outer end 254. The pivoting movement of the louver 234 about the axis 252 is indicated by arrows "I" and "J" in FIG. 4B. When the louver 234 pivots from the open position (shown in FIG. 4B) to the closed position (in FIG. 2, in the louvers located in the 12 o'clock position), the louver 234 moves as indicated by arrow "I". When the open louver 234 is moved from the closed position to the open position, it pivots as indicated by arrow "J".

Figure 7:
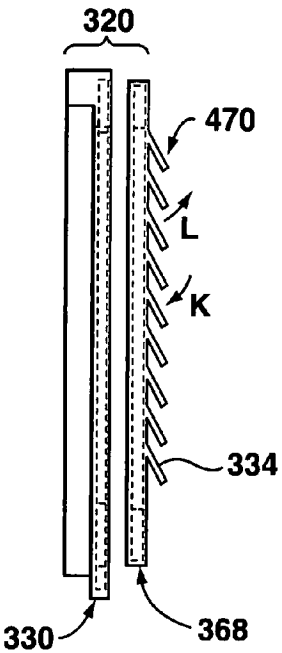
FIG. 7 is a side view of the discharge grate assembly of FIG. 6.
Figure 6:
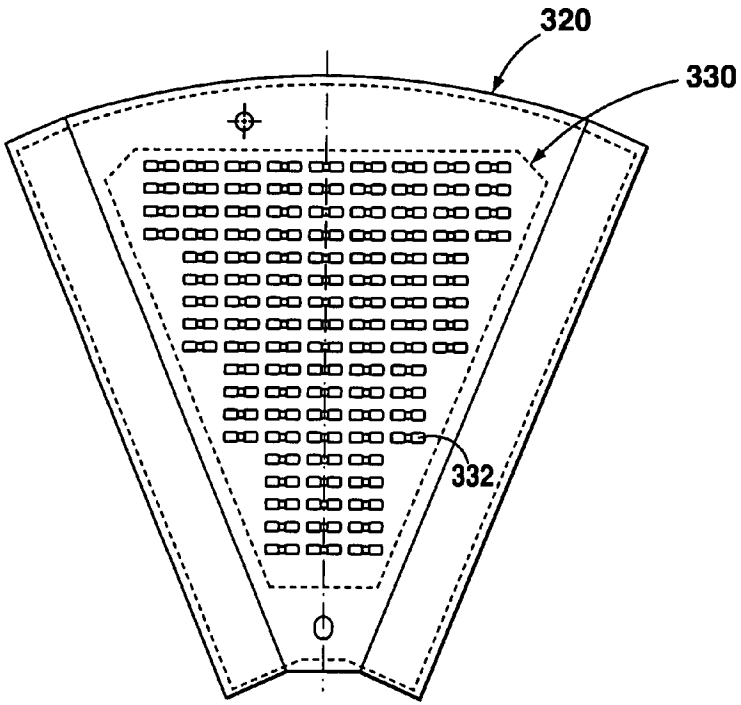
FIG. 6 is a top view of an alternative embodiment of the discharge grate assembly of the invention, drawn at a larger scale.
Figure 9:
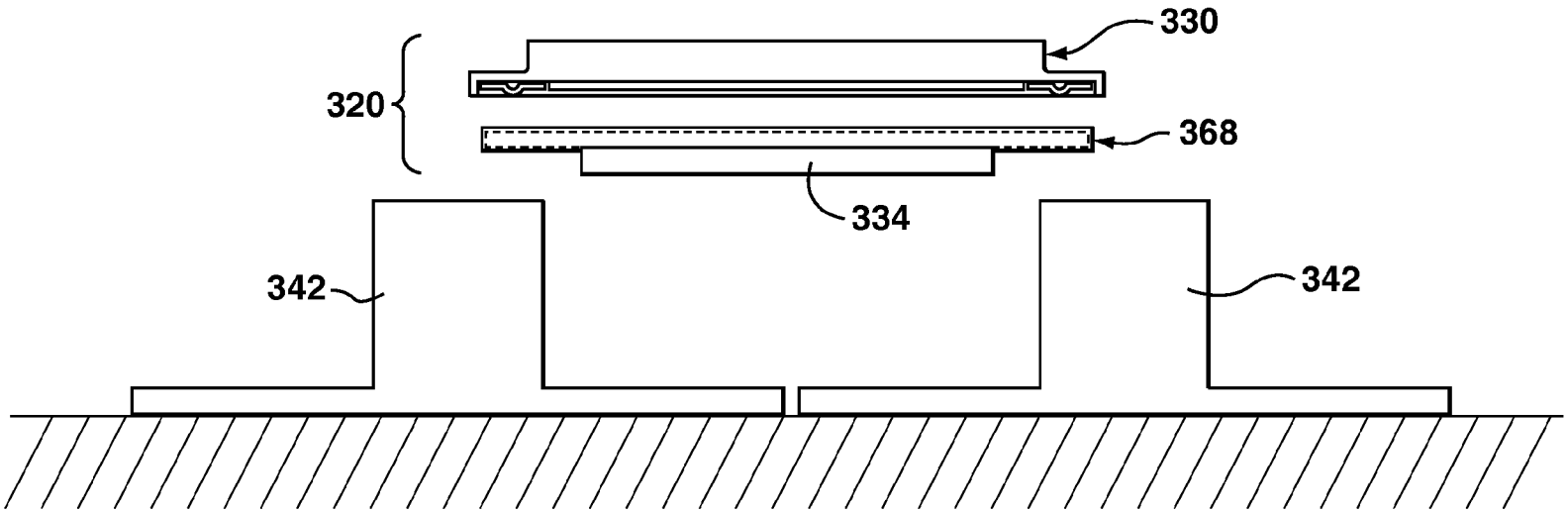
FIG. 9 is another side view of the discharge grate assembly of FIGS. 6 and 7, drawn at a smaller scale.

Another embodiment of the discharge grate assembly 320 of the invention is shown in FIGS. 6, 7, and 9. In the discharge grate assembly 320, the louvers 334 preferably are mounted on a frame 368. As can be seen in FIGS. 6 and 7, it is preferred that the discharge grate assembly 320 also includes a body 330 with apertures 332 therein. The frame 368 preferably is positionable adjacent to the body 330 so that the louvers 334, when in the open and closed positions respectively, permit flow through the apertures and obstruct such flow, respectively.

Advantageously, because the louvers 334 are mounted on the frame 368, and the frame 368 is attachable to a body 330 of the assembly 320, the frame 368 may be used to retrofit an existing discharge grate or body. For example, as shown in FIG. 9, the frame 368 preferably is adapted to be installed between the body 330 and the pup lifter elements 342. (Fasteners for maintaining the frame 368 in position relative to the body 330 are not shown in FIG. 9 for clarity of illustration.)

In one embodiment, the louvers 334 are integrally formed with the frame 368 and are movable relative to each aperture 332 between the closed and open positions. Pivoting movement of the louver 334 from the open position to the closed position is schematically illustrated by arrow "K" in FIG. 7, and movement thereof from the closed position to the open position is schematically illustrated by arrow "L" in FIG. 7. For example, the frame 368 preferably is a large piece of a suitably flexible material, and the louvers 334 preferably are flaps cut out of the material, with a portion of each such flap remaining integrally attached to a remaining portion of the flexible material. A suitable material is rubber, however, those skilled in the art would be aware of other suitable materials.

Figure 8:
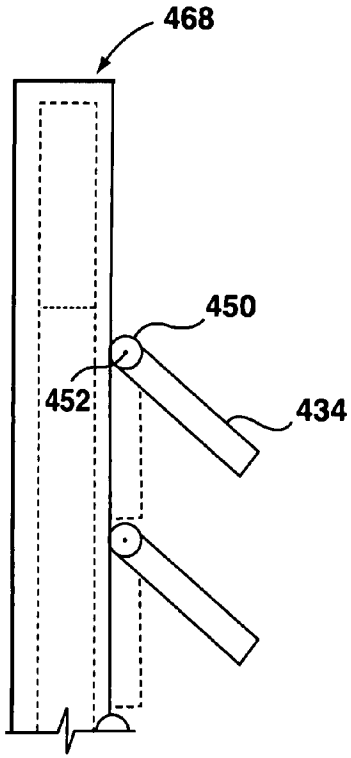
FIG. 8 is a side view of another alternative embodiment of a portion of the discharge grate assembly of the invention, drawn at a larger scale.

In another embodiment shown in FIG. 8, the discharge grate assembly of the invention includes a frame 468 and a number of hinges 450 for connecting the louvers 434 to the frame 468 respectively. As can be seen in FIG. 8, each hinge 450 defines a hinge axis 452. Preferably, the louvers 434 are pivotable about the hinge axes 452 between the closed and open positions. It is preferred that the frame 468 is positionable adjacent to the existing discharge grate 330 so that the louvers 434, when in the closed position, at least partially obstruct the apertures 332 in the discharge grate 330. Similarly, when the louvers 434 are in the open position, the apertures 332 are substantially unobstructed by the louvers 434.

As can be seen in FIGS. 7 and 9, the invention preferably includes an array 470 of louvers for use with the discharge grate 330. The array 470 of louvers 434 preferably includes the frame element 468 and a number of louvers 434 which are mounted on the frame element 468. The frame 468 preferably is mountable adjacent to the discharge grate 330, so that the louvers 434 are positioned proximal to the apertures when the frame element is mounted adjacent to the discharge grate. The louvers are movable between a closed position, in which the louvers at least partially obstruct the apertures, and an open position, in which the apertures are at least partially obstructed by the louvers.

Figure 15:
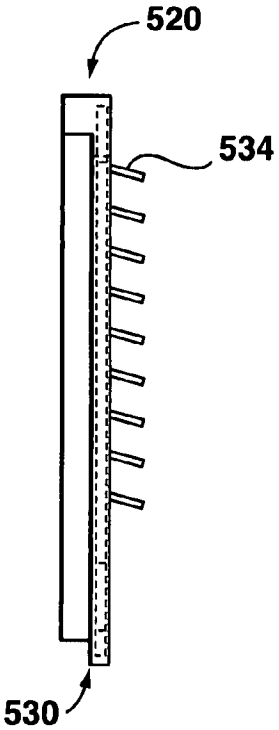
FIG. 15 is a side view of the discharge grate assembly of FIG. 14.
Figure 14:
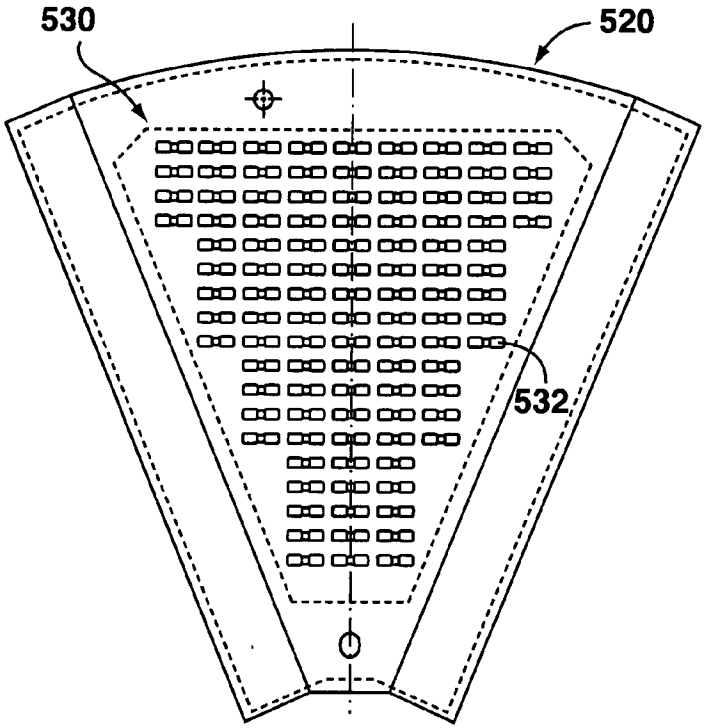
FIG. 14 is a top view of another embodiment of the discharge grate assembly of the invention.

Another embodiment of the discharge grate assembly 520 of the invention is shown in FIGS. 14 and 15. The discharge grate assembly 520 includes a body 530 with louvers 534 preferably positioned in predetermined positions relative to the apertures 532. The apertures 532 are sized for permitting the slurry with predetermined particle size characteristics to flow from the mill shell chamber to the pulp lifter chamber. In this embodiment, the louvers 534 preferably are not movable relative to the body 530. Advantageously, the discharge grate assembly 520 is easier to manufacture than the discharge grate assemblies with movable louvers therein, and therefore less costly. The louvers 534 preferably are positioned in an optimum position relative to the body 530, for optimum performance when the pulp lifter chamber is in the submerged and in the raised conditions. Preferably, the louvers 534 are disposed in one or more predetermined positions relative to the apertures 532 to permit the slurry to flow into the pulp lifter chamber 28 via the apertures 532, and to at least partially obstruct the flow of slurry out of the pulp lifter chamber via the apertures. It is believed that a suitable position is between approximately 15° and approximately 60° relative to the body.

In another embodiment of the discharge grate assembly 620 of the invention, fixed louvers 634 are positioned on a frame 668. The frame 668 is positionable adjacent to the existing discharge grate 330, so that the louvers 634 are positioned as required relative to the apertures 332. In this embodiment, the frame 668 may be retrofitted to the existing discharge grate 330.

Figure 11:
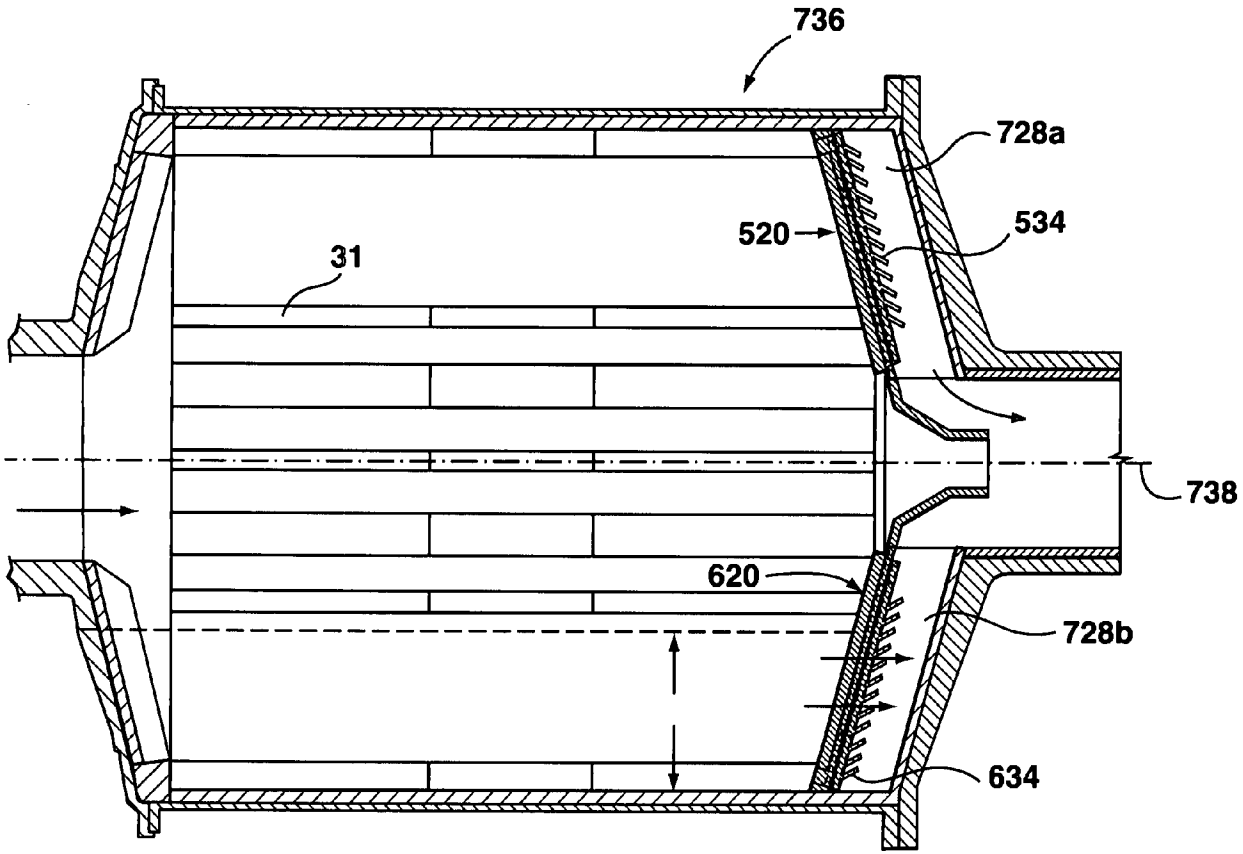
FIG. 11 is a cross-section of another embodiment of the grinding mill of the invention.
Figure 13:
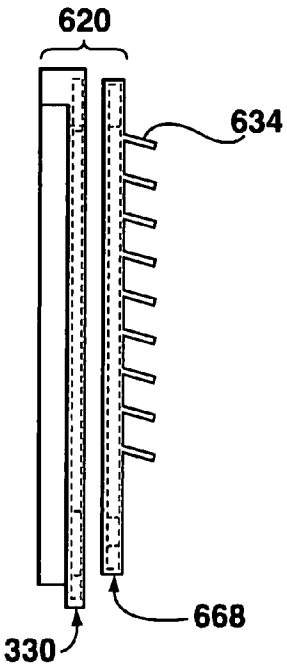
FIG. 13 is a side view of the discharge grate assembly of FIG. 12.
Figure 12:
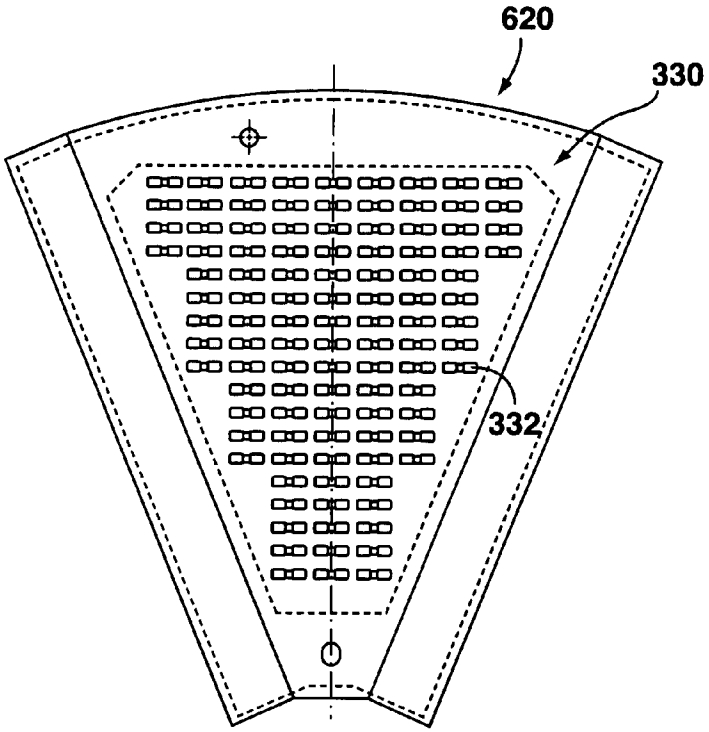
FIG. 12 is a top view of another embodiment of the discharge grate assembly of the invention, drawn at a larger scale.

In another embodiment, a grinding mill 736 includes a shell rotatable in a predetermined direction about the central axis to produce the slurry from the charge in the shell (FIG. 11). The grinding mill 736 includes the discharge end wall attached to the shell, pulp lifter elements mounted on the discharge end wall, and one or more discharge grate assemblies 520, 620 positioned on the pulp lifter elements 42.

It will be understood that the discharge grate assemblies mounted in the grinding mill 736 may be the discharge grate assembly 520, and/or the discharge grate assembly 620. Each discharge grate assembly includes the body 330 with a number of apertures 332 therein. (For convenience, in FIG. 11, the discharge grate assembly in the 12 o'clock position is assembly 520, and the assembly in the 6 o'clock position is the assembly 620, but it will be understood that such positioning is for clarity of illustration only.) Each louver 534, 634 is disposed in a predetermined position relative to each aperture 332 respectively to permit the slurry to flow into the pulp lifter chamber when the pulp lifter chamber is in the submerged condition, and to direct at least the portion of the slurry in each pulp lifter chamber to the central opening when the pulp lifter chamber is in the raised position.

As can be seen in FIG. 11 (and as described above), the louvers 534, 634 preferably are not movable relative to the discharge grate 330. Instead, in this embodiment, the louvers are positioned in an optimum position. For example, as can be seen in FIG. 11, in a pulp lifter chamber which is in the raised condition (identified as 728*a* in FIG. 11), the fixed louvers are positioned so that backflow of slurry is substantially minimized. Similarly, in the pulp lifter chamber in FIG. 11 which is in the submerged condition (identified as 728*b*), the flow of slurry into the submerged pulp lifter chamber is obstructed by the fixed louvers to a minor extent. However, the fixed louvers have the disadvantage that the louvers' positions are determined by compromise between positioning for greater flow into the pulp lifter chamber, on one hand, and less back flow, on the other hand.

It is not necessary that the angle at which each fixed louver 534, 634 in a discharge grate assembly is positioned relative to the body (i.e., relative to the aperture) is the same. Depending on the location of the louver relative to the pulp lifter chamber, the positioning of the fixed louver relative to the body may vary.

It will be appreciated by those skilled in the art that the invention can take many forms, and that such forms are within the scope of the invention as claimed. The embodiments of the invention described above are exemplary, and their scope should not be limited to the descriptions of the preferred versions contained herein.

We claim:

1. A discharge grate assembly for at least partially guiding slurry from a mill shell chamber in a rotating mill shell to a discharge trunnion thereof via a pulp lifter chamber, the discharge grate assembly comprising:

a body comprising a plurality of apertures for permitting the slurry to flow from the mill shell chamber into the pulp lifter chamber; and a plurality of louvers movable between a closed position, in which the apertures in the body are at least partially covered by the louvers, and an open position, in which the apertures are at least partially unobstructed by the louvers.

2. A discharge grate assembly according to claim 1 in which each said louver is movable between the closed and open positions at least partially due to gravity as the mill shell rotates.

3. A discharge grate assembly according to claim 2 additionally comprising at least one hinge defining a hinge axis connecting each said louver to the body, each said louver being pivotable about the hinge axis between the closed and open positions.

4. A discharge grate assembly according to claim 2 in which each said louver is integrally formed with the body and is movable relative to each said aperture respectively between the closed and open positions.

5. A discharge grate assembly according to claim 2 additionally comprising a frame on which the louvers are mounted.

6. A discharge grate assembly according to claim 2 additionally comprising:

a frame;

a plurality of hinges for connecting the louvers to the frame respectively, each such hinge defining a hinge axis; and the louvers being pivotable about the hinge axes between the closed and open positions.

7. A discharge grate assembly according to claim 2 additionally comprising a frame and in which each said louver is integrally formed with the frame and is movable relative to each said aperture respectively between the closed and open positions.

8. A grinding mill comprising a shell rotatable in a predetermined direction about a central axis thereof to produce a slurry including liquid and particles from a charge in the shell, the grinding mill comprising:

a discharge end wall attached to the shell, the discharge end wall extending between an outer edge thereof connected to the shell and an inner edge at least partially defining a central opening in the discharge end wall;

a plurality of pulp lifter elements mounted on the discharge end wall, adjacent ones of the pulp lifter elements at least partially defining pulp lifter chambers therebetween respectively;

at least one discharge grate assembly positioned on the pulp lifter elements, said at least one discharge grate assembly comprising a body with a plurality of apertures therein;

each said pulp lifter chamber being rotatable in the predetermined direction between a submerged condition, in which each said body is at least partially submerged in the charge, and a raised condition, in which at least a portion of the slurry in each said pulp lifter chamber is drainable into the central opening;

said at least one discharge grate assembly being adapted to screen the slurry through the apertures thereof as the slurry flows into each said pulp lifter chamber while each said pulp lifter chamber is in the submerged condition; and said at least one discharge grate assembly additionally comprising a plurality of louvers movable between an open position, in which the apertures are at least partially unobstructed by the louvers to permit the slurry to flow into the pulp lifter chamber when the pulp lifter chamber is in the submerged condition, and a closed position, in which the apertures are at least partially obstructed by the louvers to direct at least the portion of the slurry in each said pulp lifter chamber to the central opening when the pulp lifter chamber is in the raised position.

9. A grinding mill according to claim 8 in which each said louver is movable between the closed and the open positions at least partially due to gravity as the shell is rotated in the predetermined direction.

10. A grinding mill according to claim 9 in which said at least one discharge grate assembly additionally comprises a hinge defining a hinge axis thereof connecting each said louver to the body, each said louver being pivotable about the hinge axis between the closed and open positions.

11. A grinding mill according to claim 9 in which each said louver is integrally formed with the body and is movable relative to the body between the closed and open positions.

12. A grinding mill according to claim 8 in which said at least one discharge grate assembly additionally comprises a frame on which the louvers are mounted.

13. A grinding mill according to claim 8 in which said at least one discharge grate assembly additionally comprises a frame and in which each said louver is integrally formed with the frame and is movable relative to each said aperture respectively between the closed and open positions.

14. A discharge grate assembly for screening slurry flowing from a mill shell chamber in a rotating mill shell into a pulp lifter chamber, the discharge grate assembly comprising:

a body comprising a plurality of apertures sized for permitting the slurry with predetermined particle size characteristics to flow from the mill shell chamber to the pulp lifter chamber;

a plurality of louvers positionable for at least partially covering the apertures; and the louvers being movable between a closed position, in which the louvers at least partially cover the apertures, and an open position, in which slurry is permitted to flow through the apertures into the pulp lifter chamber.

15. A discharge grate assembly according to claim 14 in which each said louver is movable between the closed and the open positions at least partially due to gravity as the mill shell rotates.

16. An array of louvers for use with a discharge grate, the discharge grate comprising apertures therein for screening slurry flowing therethrough from a mill shell chamber in a rotating mill shell into a pulp lifter chamber, the array of louvers comprising:

a frame element;

a plurality of louvers mounted on the frame element;

the frame being mountable adjacent to the discharge grate;

the louvers being positioned proximal to the apertures when the frame element is mounted adjacent to the discharge grate; and the louvers being movable between a closed position, in which the louvers at least partially obstruct the apertures, and an open position, in which the apertures are at least partially unobstructed by the louvers.

17. An array of louvers according to claim 16 in which the frame is mountable on pulp lifter elements at least partially defining the pulp lifter chamber.

18. An array of louvers according to claim 16 in which the frame is mountable between the discharge grate and the pulp lifter elements.

19. A grinding mill comprising a shell rotatable in a predetermined direction about a central axis thereof to produce a slurry including liquid and particles from a charge in the shell, the grinding mill comprising:

a discharge end wall attached to the shell, the discharge end wall extending between an outer edge thereof connected to the shell and an inner edge at least partially defining a central opening in the discharge end wall;

a plurality of pulp lifter elements mounted on the discharge end wall, adjacent ones of the pulp lifter elements at least partially defining pulp lifter chambers therebetween respectively;

at least one discharge grate assembly positioned on the pulp lifter elements, said at least one discharge grate assembly comprising a body with a plurality of apertures therein;

each said pulp lifter chamber being rotatable in the predetermined direction between a submerged condition, in which each said body is at least partially submerged in the charge, and a raised condition, in which at least a portion of the slurry in each said pulp lifter chamber is drainable into the central opening;

said at least one discharge grate assembly being adapted to screen the slurry through the apertures thereof as the slurry flows into each said pulp lifter chamber respectively while each said pulp lifter chamber is in the submerged condition; and said at least one discharge grate assembly additionally comprising a plurality of louvers, each said louver being disposed in a predetermined position relative to each said aperture respectively to permit the slurry to flow into each said pulp lifter chamber when the pulp lifter chamber is in the submerged condition respectively, and to direct at least the portion of the slurry in each said pulp lifter chamber respectively to the central opening when the pulp lifter chamber is in the raised position.

20. A grinding mill according to claim 19 in which said at least one discharge grate assembly additionally comprises a frame on which the louvers are mounted.

21. A grinding mill according to claim 19 in which said at least one discharge grate assembly additionally comprises a frame in which each said louver is integrally formed.

22. A discharge grate assembly for screening slurry flowing from a mill shell chamber in a rotating mill shell into a pulp lifter chamber, the grate assembly comprising:

a body comprising a plurality of apertures sized for permitting the slurry with predetermined particle size characteristics to flow from the mill shell chamber to the pulp lifter chamber;

a plurality of louvers positioned for at least partially covering the apertures; and the louvers being disposed in at least one predetermined position relative to the apertures to permit the slurry to flow into the pulp lifter chamber via the apertures, and to at least partially obstruct the flow of slurry out of the pulp lifter chamber via the apertures.

* * * * *